US005299796A

United States Patent [19]

Wooldridge

[11] Patent Number: 5,299,796

[45] Date of Patent: Apr. 5, 1994

[54] EXCEPTION CARD INSERT APPARATUS AND METHOD

[75] Inventor: Cory D. Wooldridge, Brooklyn Park, Minn.

[73] Assignee: Datacard Corporation, Minneapolis, Minn.

[21] Appl. No.: 47,112

[22] Filed: Apr. 13, 1993

[51] Int. Cl.[5] ..... B65H 3/44

[52] U.S. Cl. ..... 271/9; 271/145; 271/147; 221/231; 221/123

[58] Field of Search ..... 271/145, 147, 148, 157, 271/160, 9; 221/231, 123, 133

[56] References Cited

U.S. PATENT DOCUMENTS

| | | | |
|---|---|---|---|
| 4,151,987 | 5/1979 | Toriumi et al. | 271/160 X |
| 4,750,743 | 6/1988 | Nicoletti | 271/160 X |
| 4,821,916 | 4/1989 | Dewaele | 221/231 X |
| 4,993,587 | 2/1991 | Abe | 221/231 X |
| 5,083,765 | 1/1992 | Kringel | 221/231 X |

FOREIGN PATENT DOCUMENTS

| | | | |
|---|---|---|---|
| 0008922 | 1/1987 | Japan | 271/160 |
| 3-147633 | 6/1991 | Japan | 271/145 |

*Primary Examiner*—H. Grant Skaggs
*Assistant Examiner*—Carol L. Druzbick
*Attorney, Agent, or Firm*—Merchant, Gould, Smith Edell, Welter & Schmidt

[57] ABSTRACT

An exception card input apparatus for a generally rectangular input card hopper for a card processing machine. The exception card insert apparatus has a carriage slideably mounted within the hopper for movement between a first position, proximate a driving device for removing cards from the hopper to the processing machine, and a second position, proximate a slot through the hopper cover for inserting an exception card into the hopper. The exception insert apparatus also includes a compartment in the carriage for receiving the exception card through the slot when the carriage is in the second position and the compartment is configured to place the exception card in a position for a plurality of rollers to remove the exception card from the carriage and the hopper to the processing machine when the carriage is in an intermediate position between the first and the second position. The invention also includes a method of removing an exception card from an input hopper to a card processing machine.

9 Claims, 3 Drawing Sheets

EXCEPTION CARD INSERT APPARATUS AND METHOD

FIELD OF THE INVENTION

The present invention pertains to a secured input card hopper for a card processing machine.

BACKGROUND OF THE INVENTION

Data is often placed on cards such as credit cards by printing on the cards, embossing the cards, depositing data on a magnetic strip on the card, or depositing data in an integrated circuit on the card. The placement of data on the cards by any of the methods listed above is generally done by a card processing machine. Cards to be processed by the machine are often placed stacked in a hopper adjacent the card processing machine. The cards normally are fed one by one from the hopper into the card processing machine and automatically restacked in another hopper after process of the cards is completed. Processing of the cards may proceed continuously or cards may be fed into the machine periodically in response to the demand for a card.

After the cards have been placed in the hopper, the hopper is covered and locked to prevent manipulation or theft of the cards prior to processing. If an exception card must be processed in addition to the cards in the hopper (non-exception cards), the hopper must be unlocked and the cover removed exposing the non-exception cards to manipulation or theft. This might occur, for example, when a hopper is filled with a stack of standard credit cards and there is a need to process a premium credit card.

SUMMARY OF THE INVENTION

This invention provides an exception card insert apparatus for inserting an exception card into a secured input card hopper containing non-exception cards. The present invention makes it possible to insert and exception card into the hopper without unlocking and removing the cover from the hopper and exposing the non-exception cards to manipulation or theft.

The exception card insert apparatus of the present invention is for a generally rectangular, box-like input card hopper for a card processing machine. The hopper has two oppositely disposed sides, two oppositely disposed ends, a bottom, and an oppositely disposed cover. The exception insert device includes a carriage slideably mounted within the hopper proximate one end. The carriage is mounted for movement between a first position, proximate a set of rollers for removing cards from the hopper to the processing machine, and a second position, proximate a slot through the hopper cover for inserting an exception card into the hopper.

The exception insert device also includes a compartment in the carriage for receiving the exception card inserted through the slot when the carriage is in the second position. The compartment is configured to place the exception card in a position for the rollers to remove the exception card from the carriage and the hopper to the processing machine when the carriage is an intermediate position between the first position and the second position.

The exception card insert apparatus may also include a spring for biasing the carriage toward the first position and at least one non-exception card in the hopper toward the driving means so that the non-exception card can be removed from the hopper by the rollers to the processing machine. The carriage also may have an operably connected flange to cover the slot when the cover is in the second position.

The present invention also provides a method for inserting exception card into a generally rectangular hopper for the card processing machine. The hopper has two oppositely disposed sides, two oppositely exposed ends, and cover oppositely disposed from a bottom. The method includes grasping a lever disposed outside the hopper. The lever is operably connected to a slideably mounted carriage within the hopper. The method also includes the steps of moving the lever so that the carriage is moved from a first position to a second position and inserting the exception card through a slot into the hopper to a compartment in the carriage. Finally, the method includes step of releasing the lever so that a biasing means slides the carriage and the card toward the first position to an intermediate position where rollers remove the exception card from the hopper to the processing machine.

DETAILED DESCRIPTION OF THE PREFERRED EMBODIMENT

Figure 1:
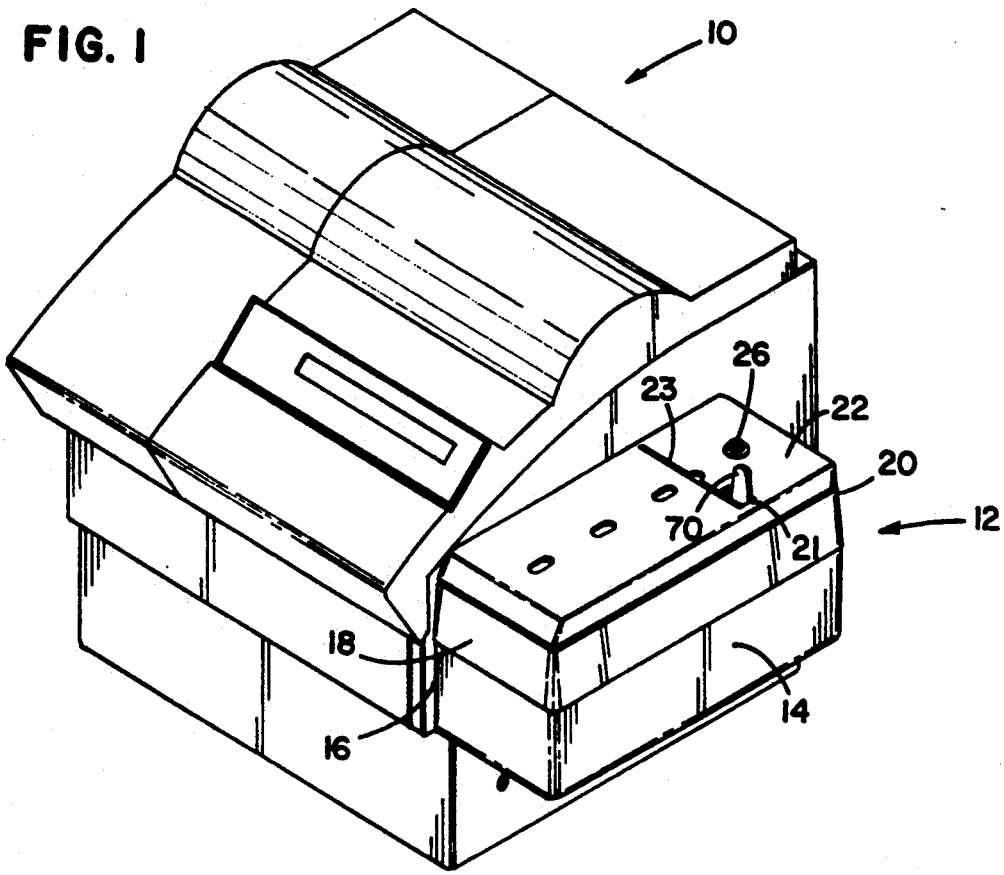
FIG. 1 shows a perspective view of a card processing machine and an input card hopper.

Referring now to the drawings, wherein like reference numerals designate identical or corresponding parts throughout the several views, FIG. 1 shows a card processing machine, such as an embosser, generally referred to by the numeral 10. Operably connected to card processing machine 10 is a generally rectangular box-like input card hopper 12. Input card hopper 12 has two oppositely disposed sides 14 and 16, and two oppositely disposed ends 18 and 20. In one embodiment, side 16 of input card hopper 12 is a side of card processing machine 10. Input card hopper 12 also has a cover 22 and, as shown in FIG. 2, an oppositely disposed bottom 24.

As shown in FIG. 1, a lock 26 is preferably provided to secure cover 22 on input card hopper 12. Cover 22 has a slot 23 disposed approximately parallel to end 20. Proximate one end of slot 23 is a widened portion 21 disposed toward end 20.

Figure 2:
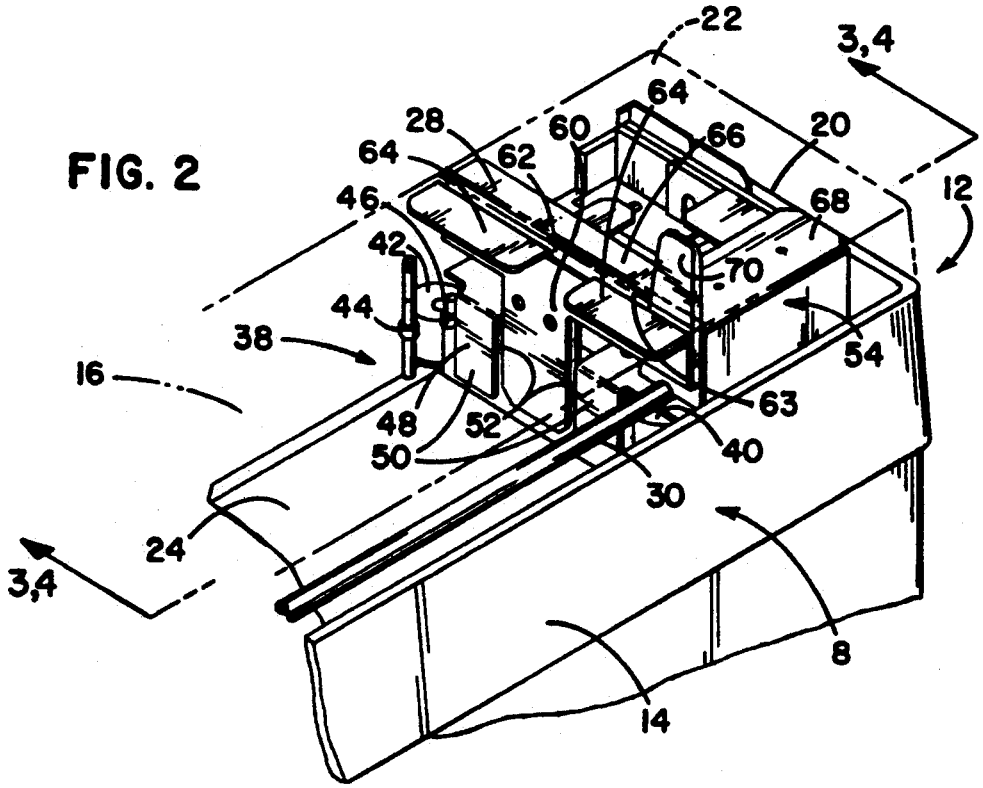
FIG. 2 shows a perspective view of a portion of an input card hopper.

FIG. 2 shows a partial view of input card hopper 12 with cover 22 shown by broken lines. Also shown in FIG. 2 is an Exception Card Insert Apparatus 8 disposed generally within and operably connected to hopper 12.

Figure 3:
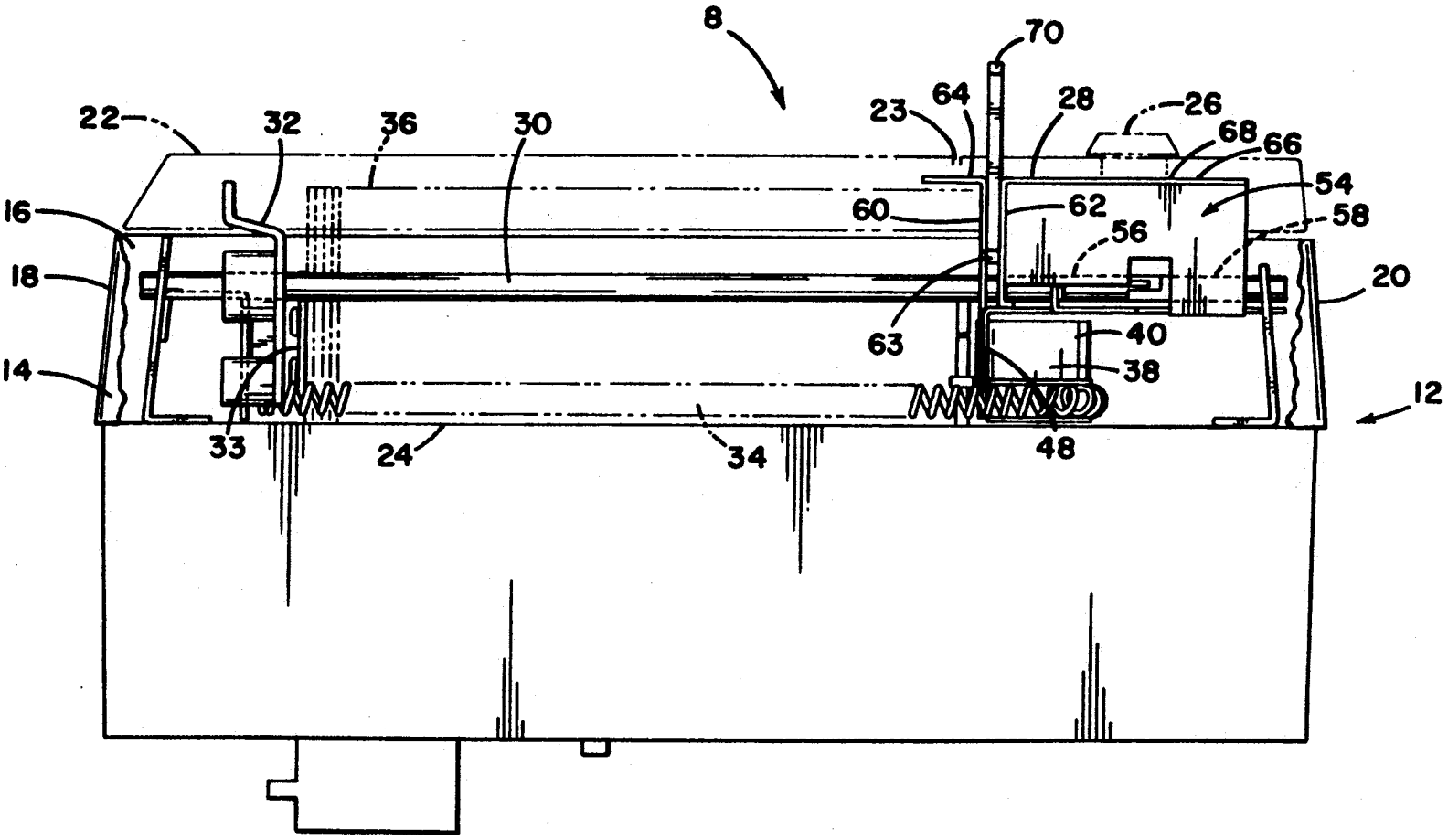
FIG. 3 shows a cross-sectional view of an input card hopper wherein a carriage is in a first position, the cross section being taken from FIG. 1.

FIG. 3 shows a crossectional view of input card hopper 12 with cover 22 shown with broken lines. As shown in FIGS. 2 and 3, insert apparatus 8 preferably includes a rail 30 extending approximately parallel to sides 14 and 16 from proximate end 18 to proximate end 20 within input card hopper 12. Rail 30 is preferably a generally rigid elongated rod having a circular cross-section.

Insert apparatus 8 also preferably includes a carriage 28 slidably mounted on rail 30 generally within input card hopper 12. Carriage 28 includes a rail mounting means 54 for mounting carriage 28 to rail 30. Rail mounting means 54 is preferably a block-like member having an archic groove 56 with a radius slightly greater than the radius of rail 30. Rail mounting means 54 also preferably has a cylindrical opening 58 having a radius slightly greater than the radius of rail 30. Rail mounting means 54 is mounted on rail 30, with rail 30 extending through opening 58 and groove 56 resting atop rail 30.

Carriage 28 also includes two approximately parallel plates 60 and 62 disposed approximately perpendicular to bottom 24 and forming an exception card compartment 63 between plates 60 and 62. Plates 60 and 62 are preferably T-shaped, each having a stem portion proximate bottom 24 and a cross portion proximate cover 22. Extending toward end 18 from the cross portion of plate 60 proximate cover 22 is at least one flange 64. Flange 64 is approximately perpendicular to plate 60 and spans approximately 50% or more of the distance between sides 14 and 16. Plate 62 has a flange 66 which extends toward end 20 from the cross portion of plate 62 proximate cover 22. Flange 66 spans approximately 50% or more of the distance between side 14 and side 16. Flange 66 has an additional expanded portion 68 operably connected to rail mounting means 54.

Disposed between and operably connected to plates 60 and 62 is lever 70. Lever 70 extends through widened portion 21 of cover slot 23.

Figure 4:
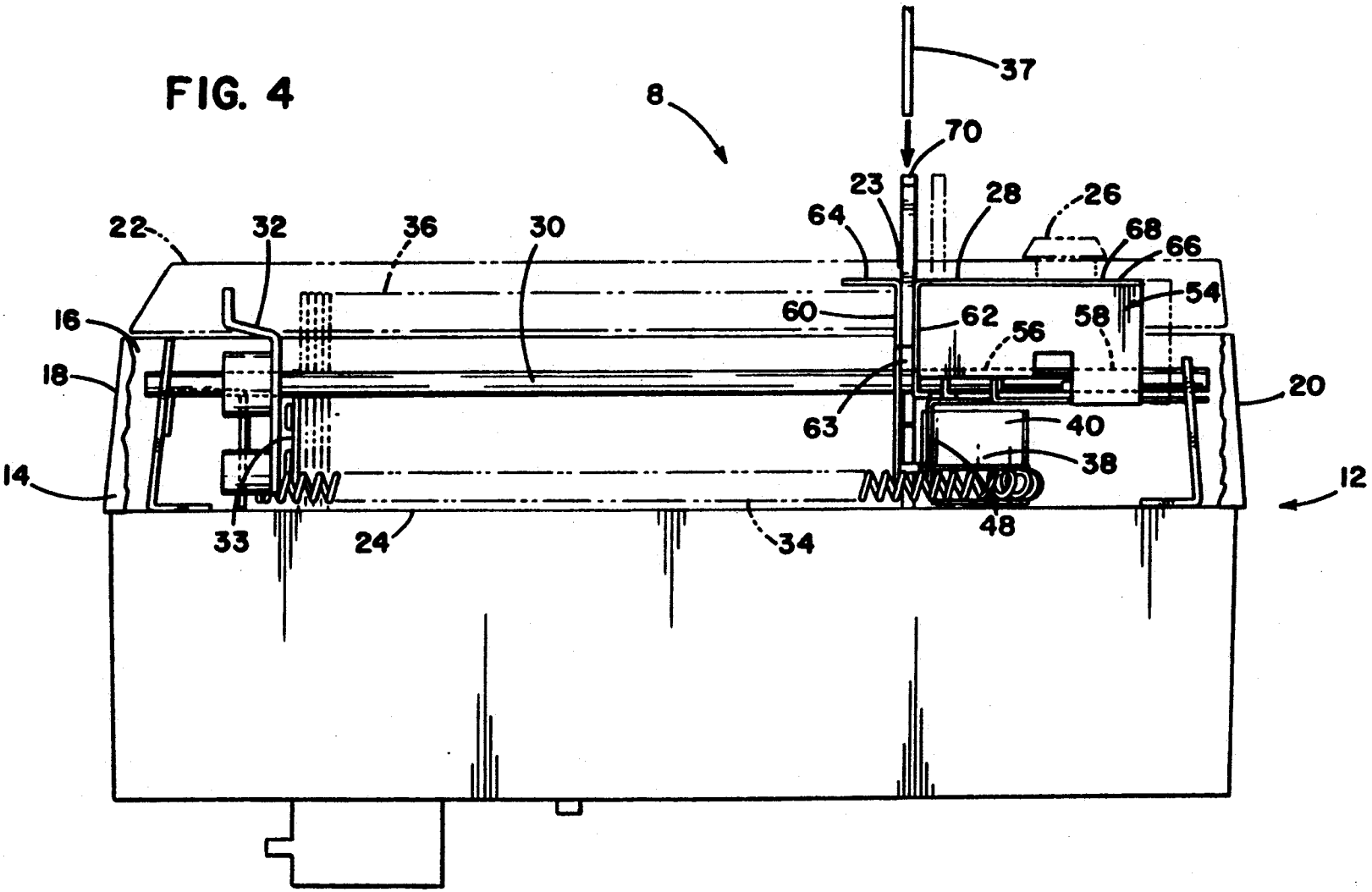
FIG. 4 shows a cross-section of the input card hopper, wherein the carriage is in a second position, the cross section being taken from FIG. 1.

Carriage 28 is movable along rail 30 between a first position wherein plate 60 of carriage 28 is approximately aligned with card backstop 48, and a second position wherein plates 60 and 62 are disposed on opposite sides of slot 23 in cover 22. FIG. 3 shows carriage 28 in the first position, and FIG. 4 shows carriage 28 in the second position.

Also slidably mounted on rail 30 is a pusher assembly 32. Pusher assembly 32 includes a card pusher plate 33. Card pusher plate 33 is preferably approximately parallel to end 18.

Disposed between pusher assembly 32 and carriage 28 are a plurality of non-exception cards 36 shown by broken lines in FIG. 3. Cards 36 are usually generally rectangular in shape and made substantially of plastic like, for example, a credit card. An exception card 37 is shown in FIG. 4. Exception cards 37 are generally the same shape and made from substantially the same material as nonexception cards.

Pusher assembly 32 is biased toward end 20 by biasing means 34 for biasing non-exception cards 36 and carriage 28 toward end 20. Biasing means 34 is preferably a helical spring, however, other embodiments of biasing means 34 will be readily apparent.

Also disposed within input card hopper 12 is a driving means 38 for removing cards from input card hopper 12 to card processing machine 10. Driving means 38 is disposed proximate an opening through side 16 for transferring cards 36 and exception cards from hopper 12 to card processing machine 10.

FIG. 2 shows a suitable driving means 38 known in the art, including a cam picker 40, a driving roller 42, an oppositely disposed guide roller 44, and a feeder roller 46. Cam picker 40 is approximately cylindrically shaped having a smooth cylindrical surface with a sharp edged notch. Cam picker 40 is eccentrically rotatably mounted in hopper 12 about a rotation axis approximately perpendicular to bottom 24. The sharp edged notch is disposed opposite the rotational axis of cam picker 40. Operably connected to hopper 12 and disposed proximate card processing machine 10 are driving roller 42, guide roller 44, and feeder roller 46. Feeder roller 46 is rotatably mounted about a rotational axis approximately perpendicular to bottom 24 of hopper 12. Disposed toward card processing machine 20 from feeder roller 46 are driving roller 42 and oppositely disposed guide roller 44. Driving roller 42 and guide roller 44 are rotatably mounted about rotational axes approximately perpendicular to bottom 24 of hopper 12 to drive cards 36 into machine 10, as known in the art.

As shown in FIGS. 2-4, hopper 12 also includes a card backstop 48. Card backstop 48 is disposed to one side of the opening into the card processing machine 10 toward end 20. Card backstop 48 has a generally flat surface 50 approximately parallel end 20. Flat surface 50 of card backstop 48 preferably has an opening 52 large enough to allow the stem portion of carriage 28 to pass through. The rotational axis of cam picker 40, driving roller 42, and feeder roller 46 are disposed toward end 20 of hopper 12 from flat surface 50 of card backstop 48. Cam picker 40 including the sharp-edged notch, driving roller 42, and feeder roller 46 extend beyond flat surface 50 of card backstop 48 toward end 18. Guide roller 44 is disposed proximate driving roller 42 and toward end 18.

In use, the hopper 12 is filled first with one or more non-exception cards 36. To place non-exception cards 36 in hopper 12 lock 26 is unfastened and cover 22 removed. Pusher assembly 32 is slid along rail 30 toward end 18 of hopper 12. Non-exception cards 36 are then placed in hopper 12 between card pusher plate 33 and flat surface 50 of card backstop 48. Biasing means 34 then biases pusher assembly 32 toward card backstop 48 and carriage 28 toward the first position, as shown in FIG. 3. Cover 22 is then replaced on hopper 12 and lock 26 secured.

Once non-exception cards 36 are locked within hopper 12, exception cards 37 can be inserted into hopper 12 and driven into card processing machine 10 by first moving carriage 28 to the second position, by moving lever 70 toward end 18. When carriage 28 is in the second position, a exception card 37 can be inserted in slot 23 and be placed in compartment 63 between plates 60 and 62 of carriage 28. Lever 70 is then released and biasing means 34 biases pusher assembly 32 and non-exception cards 36 against carriage 28, pushing carriage 28 toward the first position. Before carriage 28 reaches the first position, however, exception card 37 will encounter card backstop 48, preventing the continued movement of both the exception card 37 and carriage 28 toward the first position. At this, an intermediate position, cam picker 40 will rotate and, as known in the art, the sharp-edge notch will engage with an end of exception card 37 proximate side 14 opposite card processing machine 10. Cam picker 40 then pushes exception card 37 between driving roller 42 and guide roller 44. Driving roller 42 then rotates pushing the exception card 37 into processing machine 10. Carriage 28 then returns to the first position as a consequence of biasing means 34 basing cards 36 toward card backstop 48. Flange 64 of carriage 28 is then disposed between slot 23 in cover 22 and non-exception cards 36 so that nonexception cards 36 cannot be removed through slot 23.

While the present invention has been described in connection with the preferred embodiment thereof, it will be understood many modifications will be readily apparent to those skilled in the art, and this application is intended to cover any adaptations or variations thereof. It is manifestly intended this invention be limited only by the claims and equivalents thereof.

What is claimed is:

1. An exception card insert apparatus for a generally rectangular box-like input card hopper for a card processing machine, the hopper having two oppositely disposed sides, two oppositely disposed ends, a bottom, and an oppositely disposed cover, the exception card insert apparatus comprising:

a carriage slideably mounted within the hopper proximate one end and movable between a first position proximate driving means for removing cards from the hopper to the processing machine, and a second position proximate a slot through the hopper , an exception card being insertable into the hopper through the slot; and a compartment in the carriage receiving the exception card inserted through the slot when the carriage is in the second position and the compartment configured to place the exception card in a position proximate the driving means to allow removal of the exception card by the driving means from the carriage and the hopper to the processing machine when the carriage is in an intermediate position between the first position and the second position.

2. The exception card insert apparatus, in accordance with claim 1, further comprising a biasing means for biasing the carriage toward the first position and at least one non-exception card in the hopper toward the driving means so that the non-exception card can be removed from the hopper to the processing machine.

3. The exception card insert apparatus, in accordance with claim 1, the carriage having an operably connected flange to cover the slot when the carriage is not in the second position.

4. The exception card insert apparatus, in accordance with claim 1, further comprising a lever operably connected to the carriage and extending outside the hopper to allow a user to move the carriage from the first position to the second position.

5. An exception card insert apparatus for a generally rectangular box-like input card hopper for a card processing machine, the hopper having two oppositely disposed sides, two oppositely disposed ends, a bottom, and an oppositely disposed cover, the exception card insert apparatus comprising:

a rail disposed within the hopper substantially parallel the sides;

a carriage slideably mounted on the rail proximate a first end of the hopper for movement between a first position proximate a driving means for removing cards from the hopper into the processing machine, and a second position proximate a slot through the hopper for insertion of an exception card into the hopper; and a compartment in the carriage for receipt of the exception card through the slot when the carriage is in the second position, the compartment being configured to place the exception card in a position for the driving means to remove the exception card from the carriage and the hopper to the processing machine when the carriage is in an intermediate position between the first position and the second position.

6. The exception card insert apparatus, in accordance with claim 5, further comprising a biasing means for biasing the carriage toward the first position and at least one non-exception card in the hopper toward the driving means so that the non-exception card can be removed from the hopper to the processing machine.

7. The exception card insert apparatus, in accordance with claim 5, the carriage having an operably connected flange to cover the slot when the carriage is not in the second position.

8. The exception card insert apparatus, in accordance with claim 5, further comprising a lever operably connected to the carriage and extending outside the hopper for a user to move the carriage from the first position to the second position.

9. A method for inserting an exception card into a generally rectangular hopper for a card processing machine, the hopper having two oppositely disposed sides, two oppositely disposed ends, and a cover oppositely disposed from a bottom, the method comprising the steps of:

grasping a lever disposed outside the hopper, the lever being operably connected to a slideably mounted carriage within the hopper;

moving the lever so that the carriage is moved from a first position to a second position;

inserting the exception card through a slot into the hopper into a compartment in the carriage; and releasing the lever so that a biasing means slides the carriage and the card toward the first position to an intermediate position where a driving means removes the exception card from the hopper to the processing machine.

* * * * *